United States Patent [19]

Grant

[11] Patent Number: 4,462,623

[45] Date of Patent: Jul. 31, 1984

[54] SAFETY DOOR STOPPER

[76] Inventor: Craig A. Grant, 36 Elaine Ave., Portsmouth, R.I. 02871

[21] Appl. No.: 426,397

[22] Filed: Sep. 29, 1982

[51] Int. Cl.[3] ..... E05C 1/10

[52] U.S. Cl. ..... 292/175; 292/DIG. 15; 292/DIG. 22; 292/DIG. 4

[58] Field of Search ..... 292/175, 147, 150, 152, 292/251.5, DIG. 22, DIG. 4, DIG. 15

[56] References Cited

U.S. PATENT DOCUMENTS

| | | | |
|---|---|---|---|
| 1,877,177 | 9/1932 | Hinderer et al. | 292/175 X |
| 1,940,084 | 12/1933 | Grasso | 292/175 X |
| 2,264,962 | 12/1941 | Adams | 292/147 |
| 3,330,585 | 7/1967 | Pollin | 292/DIG. 15 |
| 4,343,500 | 8/1962 | Steiner | 292/DIG. 15 |

*Primary Examiner*—Richard E. Moore
*Attorney, Agent, or Firm*—Robert J. Doherty

[57] ABSTRACT

A foot operated door stop adapted to be positioned in a floor opening adjacent the door so as to effectively limit its degree of opening as a safety and anti-burglar means. This door stopper is in the form of inner and outer telescopically mounted cylindrical members. The inner cylinder is spring urged to an extended position wherein such member projects upwardly from the floor in a door blocking position. The inner member is guided by specific means at the upper and lower ends of the outer member and a particular detent assembly is mounted in such inner member so as to present the means by which the inner member may be held in its retracted or non-operative position. The inner cylinder is also adapted to freely rotate with respect to the outer cylinder.

5 Claims, 6 Drawing Figures

FIG. 1
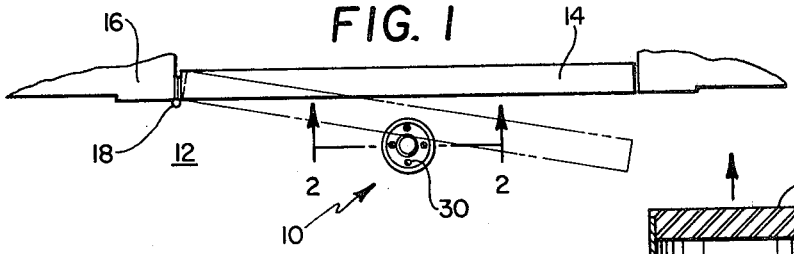
FIG. 2
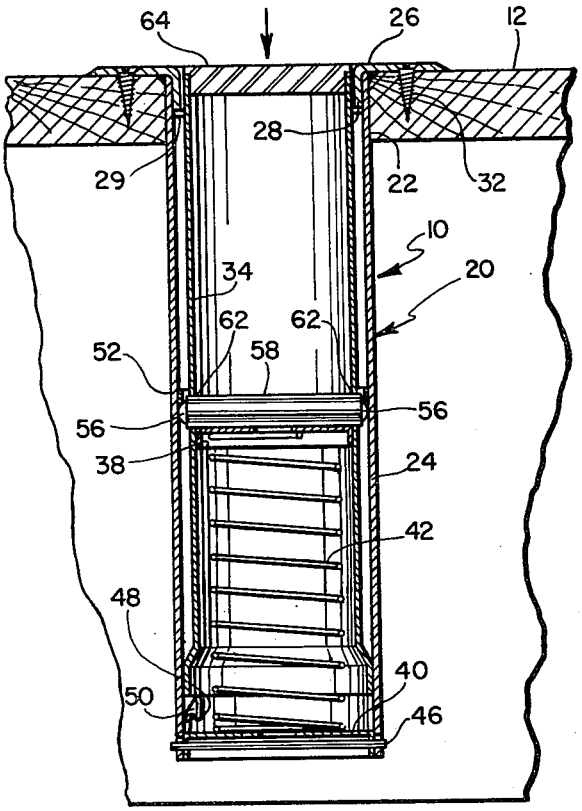
FIG. 3
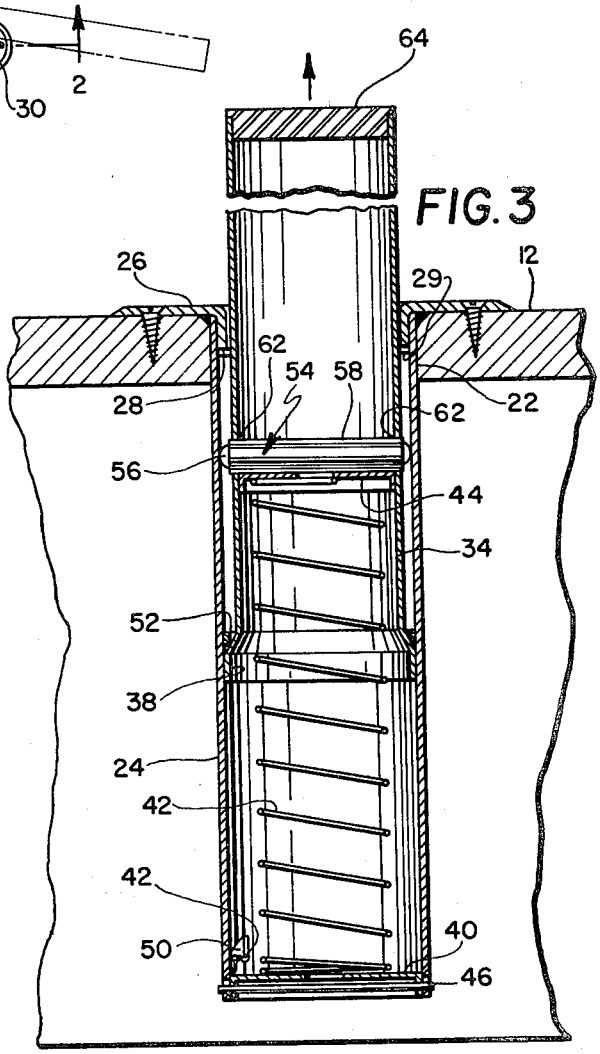
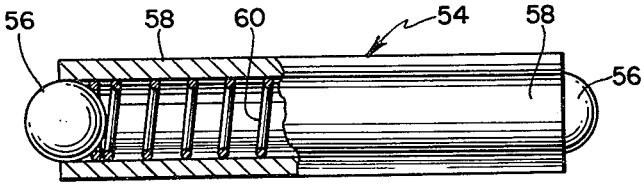
FIG. 4
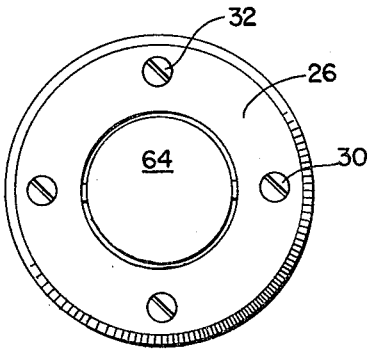
FIG. 5
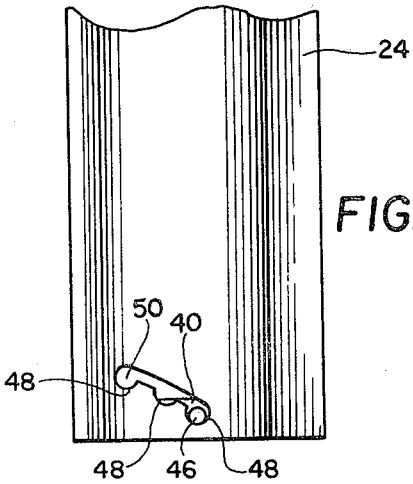
FIG. 6

SAFETY DOOR STOPPER

BACKGROUND AND OBJECTS OF THE INVENTION

This invention is directed to a safety device in the form of a door stop which is adapted to be positioned generally in an opening in the floor adjacent the door. Other mountings are, however, possible, for instance, the door stop may be mounted in the wall or ceiling adjacent the door and, accordingly, be more appropriately hand operated. In any event, the door stop of the present invention represents an improved construction over those presently available in that it is reliable, simple to operate, and of low cost construction. The device is furthermore easily mountable in its operable position flush with the surface adjacent the door and involving formation of but a single mounting opening or end. The device also is easily removable as a unit and formed from components which may be individually replaced.

Prior art publications of which the present applicant is aware and which the present device forms ann improvement thereover include the following U.S. Pat. Nos. 628,795 to Harkness patented July 11, 1899; 1,036,098 to Harkness patented Aug. 20, 1912; 1,866,233 to Tarrant patented July 5, 1932; 1,940,084 to Grasso patented Dec. 19, 1933; 3,330,585 to Pollin patented July 11, 1967; and West German Pat. No. 1,584,058 patented Mar. 26, 1970.

Although applicant is not aware of whether or not the devices described in the various patents have been produced or commercially available, they appear to present drawbacks or limitations which are overcome by the present device. Such advantages as well as those previously indicated as desirable for door stops of this present type are accomplished by the provision of a door stop adapted for positioning in an opening in a surface adjacent a movable door and adapted to move from a retracted position wherein said door may move therepast to an extended position wherein said door movement is prevented, said door stop comprising an outer cylindrical housing having upper and lower ends, said upper end being open and adapted for positioning substantially flush with said surface, an inner member with an outer cylindrical surface adapted to telescopically slide in free rotational relation to the inner surface of said outer cylinder between said retracted and extended positions, said inner member having an enlarged annular lower end adapted to slidably contact said outer cylinder inner surface so as to function as lower guide means, and said outer cylinder open upper end including means for slidably contacting said inner member and acting as upper guide means, spring means for continually urging said member upwardly to its extended position wherein it projects above said outer cylinder upper end so as to contact and block said movement of said door, positioning means inwardly extending from said outer cylinder at an intermediate location between the ends thereof, said inner member including outwardly biased detent means adapted to extend from the outer surface thereof at an intermediate point thereof and engage undersurface portions of said positioning means such that said member is retained in said retracted position, said member downwardly movable against the action of said spring means by pressure applied to the top thereof such that sudden release thereof enables said detent means to move past said positioning means to its extended position wherein said enlarged lower end of said member positively contacts said positioning means so as to prevent further upward movement of said member by said spring.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention;

FIG. 1 is a schematic plan view of the manner in which the device of the present invention may be positioned in conjunction with a normally hinged door;

FIG. 2 is an enlarged cross-sectional view taken along the line 2—2 of FIG. 1 and shows in particular the device of the present invention in its retracted or non-operable position;

FIG. 3 is a view similar to FIG. 2 but showing the device in its extended position wherein it functions to stop the door from fully opening;

FIG. 4 is an enlarged partially cross-sectional view of the detent assembly of the present invention;

FIG. 5 is a top plan view of the device shown in the FIG. 2 or 3; and FIG. 6 is a partial side elevational view showing in particular the manner in which the spring tension may be regulated.

DESCRIPTION OF THE INVENTION

Turning now to the drawing and more particularly to FIG. 1 thereof, the door stop safety device 10 of the present invention is shown positioned in a countersunk position within the adjacent floor portion 12 of a house or other structure in which a door 14 is swingably mounted to a door frame 16 by conventional hinges 18. Such particular door construction is shown by illustration only and it should be brought out that the present door stop device 10 may also be used with other types of door constructions although the type illustrated is by far the most common arrangement. Generally the device 10 of the present invention includes an elongated body 20 which is adapted to extend in a countersunk position within a circular opening 22 formed in the floor 12 of the supporting structure. The body 20 is adapted to extend below the floor into the space formed by the supporting floor joists (not shown), i.e., to extend downwardly into the basement, crawl space, etc. between such floor joist when the door stop 10 is mounted on the first floor of a conventionally constructed house and the like. Obviously the device may also be mounted on upper floors as well and may also be mounted on stairs, on walls as when controlling a sliding door and the like.

The body 20 includes an outer cylindrical housing 24 formed of any suitable material such as tubular steel and the like and is essentially open at both ends thereof. The upper end is provided with a positioning flange 26 which includes a tubular downwardly extending lip 28 adapted to extend into the interior of the upper open end of the outer housing 24. The flange 26 is welded or otherwise suitably secured to the upper open end of the housing 24. In addition, the flange 26 is provided with a plurality of openings 30 whereby the flange may be releasibly secured to the floor 12 as by mounting screws 32 and the like.

An inner cylindrical housing 34, also constructed of similar rigid material such as that used in forming the outer housing 24 is adapted to be mounted in telescoping position within the interior of the outer housing 24 in its retracted position as shown in FIG. 2 and to protrude outwardly from the open upper end of the outer housing 24 in its extended or operable position as shown in FIG. 3. It is desirable that the relationship between the housing 34 and 24 is such that there is very little lateral play therebetween such that movement of the door 14 against the protruding portion of the inner cylinder 34 will not cause leverage to be applied to the sidewall of the inner cylinder 24 where it contacts the outer cylinder 24 or portions thereof, that is, it is desirable to avoid relative point contact between the outer portions of the inner cylinder 34 and other members or components of the device 10. In this regard, downwardly extending tubular portion 28 of the flange 26 forms a guide whereby the inner cylinder contacts such lip or tube thus serving as an upper guide to such inner housing. Also a ring-shaped strip 29 of felt or the like may be glued or otherwise attached to the inner cylinder 34 beneath the tubular portion 28 of the flange so as to prevent dirt, small objects, and the like from falling between the cylinders 34 and 24 and possibly interfering with the operation of the device. The cylinder 34 could alternatively be currugated, that is, fluted, so as to let dirt, etc. run through and thus prevent it from grinding between the cylinders.

The lower portion of the inner cylinder 34 is outwardly flared in a bell-shaped terminal lower end 38 and in this manner provides for the guiding of such inner cylinder 34 in relationship of the outer cylinder 24 at the lower portions thereof. The bottom of the outer cylinder 24 is provided with a supporting platform 40 against which a coil spring 42 is adapted to rest. The upper end of the coil spring 42 extends inwardly into the lower portion of the inner cylinder 34 where it is adapted to contact an upper platform 44 or other suitable limiting means provided at intermediate positions relative to the inner cylinder 34. It, accordingly, should be seen that the coil spring 34 serves to continually urge the inner cylinder 34 upwardly to its protruding position as shown in FIG. 3.

The bottom platform 40 may be held in place by any suitable means including a laterally extending pin 46 adapted to extend through openings in the outer cylinder 24 which are aligned with openings provided in downwardly extending ears from such platform 40. As best shown in FIG. 6, the openings on either side of the outer housing 24 may be aligned lobes 48 of increasing height within a slot 50. A slot 50 is formed on each side such that by manipulating the pin 46 upwardly or downwardly, the tension on the spring 42 may be increased or decreased, that is, platform 40 may be raised or lowered to provide the desired spring tensioning.

The inner surface of the outer cylinder 24 is provided with a positioning or stop ring 52 suitably secured to the inner surface thereof either through a press-fit, welding, and the like. Such ring 52 extends inwardly a suitable distance such that it provides a positive stop when the enlarged flange or bell housing 38 contacts such in the extended position shown in FIG. 3. Such contact between the enlarged lower end 38 of the inner housing 34 and such ring determines the height to which the upper end of the inner cylinder 34 will project above the floor 12. It should also be brought out that the inner cylinder 34 is free to rotate relative to the outer cylinder 24 such that the relative longitudinal movement of the inner cylinder 34 during operation of the device over long periods of use will not cause uneven wear resulting in undesirable weakness to either of the housing members.

A positioning member 54 is mounted within the inner cylinder 34 so as to temporarily position the inner cylinder 34 in its retracted position. This is accomplished by mounting detent means in the form of a pair of outwardly spring urged balls or detents 56 therein. Such detents 56 are positioned in the outer open ends of a tubular body 58 and spring urged outwardly by a compressed spring 60 mounted interiorly of the body of such positioning means positioning member 54. The detents 56 outwardly extend into contact with the interior surface portions of the outer cylinder 24 and in the retracted position of the device shown in FIG. 3 are adapted to engage under portions of the ring 52 so as to hold the inner cylinder in the position in such figure. The body 58 of the positioning means 54 is adapted to extend laterally across the inner cylinder 34 and be held therein by openings 62 provided in the opposite wall thereof. The compression of the spring 60 is such that the detents 56 may be inwardly compressed as by a force exerted thereto by the ring 52 when the inner cylinder is temporarily compressed to a lowered position than that shown in FIG. 2 (the cylinder 34 may move downwardly until its terminal end 38 contacts the platform 40) and allowed to upwardly move so as to gain momentum and thereby enable the detent to be temporarily compressed and moved passed the ring 52.

Such action is accomplished pressing downwardly on the top of the inner cylinder by one's foot, hand, and the like and then quickly releasing such pressure. The upper open end of the inner cylinder 34 is provided with a top or cap 64 for such purpose. Such cap 64 is formed from a suitable material such as plastic and the like and may be made of a distinctive color, luminescent or the like such that the activation area of the device may be more visible at night and the like. By regulating the tension or compression of the springs 42 and 60, the relative forces necessary for smooth, fail safe operation of the device may be achieved. In addition, the manipulation of the device is accomplished by action on the inner cylinder member which enables the opening movement of the door 14 to be stopped rather than a secondary device in turn operated by this member. This simplifies the operation of the overall safety device 10 of the present invention through the elimination of linkage, possible malfunction of secondary activation devices and the like.

In addition, the inner cylinder is constantly guided and maintained against an undesirable degree of lateral play such that forces exerted by the door 14 will not cause concentration of forces at a particular point in the outer surface of the inner cylinder 34 and thus enables the cylinder 34 to be made of otherwise more lightweight material than would be necessary with devices which did not maintain this relationship. Also, the downward travel of the inner cylinder 34 is limited to about $\frac{1}{4}$ inch or so such that accidentally stepping on the cap 64 as with high heels or the like will not cause the cylinder to move downwardly to an alarming degree or one in which a person's heel could be caught. This downward travel is limited by sizing the length of the cylinder 34 such that its terminal end 38 terminates about $\frac{1}{4}$ inch above the platform 40 in its FIG. 2 position. It is, accordingly, believed that the above-described device accomplishes the favorable overall specific objectives of the present invention.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A safety device in the form of a door stop adapted for positioning in an opening in a surface adjacent a movable door and adapted to move from a retracted position wherein said door may move therepast to an extended position wherein said door movement is prevented, said door stop comprising an outer cylindrical housing having upper and lower ends, said upper end being open and adapted for positioning substantially flush with said surface, an inner member having an outer cylindrical surface, said inner member positioned to telescopically slide in free rotational relation to the inner surface of said outer cylinder between said retracted and extended positions, said inner member having an enlarged annular lower end positioned to slidably contact said outer cylinder inner surface so as to function as lower guide means, and said outer cylinder open upper end including means for slidably contacting said inner member and acting as upper guide means, spring means for continually urging said member upwardly to its extended position wherein it projects above said outer cylinder upper end so as to contact and block said movement of said door, positioning means inwardly extending from said outer cylinder at an intermediate location between the ends thereof, said inner member including outwardly biased detent means adapted to extend from the outer surface thereof at an intermediate point thereof and engage undersurface portions of said positioning means such that said member is retained in said retracted position, said member downwardly movable against the action of said spring means by pressure applied to the top thereof such that sudden release thereof enables said detent means to move past said positioning means to its extended position wherein said enlarged lower end of said member positively contacts said positioning means so as to prevent further upward movement of said member by said spring.

2. The device of claim 1, said inner member being cylindrical, said positioning means being a ring and said detent means including a bar extending across the inside of said inner cylinder, said spring means for upwardly urging said inner cylinder being a coil spring extending upwardly into said inner cylinder from the bottom of said outer cylinder to said detent means bar.

3. The device of claim 2, said detent bar being an open ended tube having a ball detent positioned at opposite open ends thereof said ball detents inwardly movable into said tube against the action of a spring mounted in said tube and adapted to outwardly urge said ball detents against the inner surface of said outer cylinder.

4. The device of claim 1, said upper guide means including an annular flange having a tubular lip downwardly extending from the central opening thereof, said flange adapted for supporting contact and attachment to said surface and wherein said lip is adapted for said slidable contact with said inner member.

5. The device of claim 2, including means for changing the tension of said coil spring to modify the force with which said inner member is upwardly urged past said ring.

* * * * *